US008195061B2

(12) United States Patent
Jo

(10) Patent No.: US 8,195,061 B2
(45) Date of Patent: Jun. 5, 2012

(54) IMAGE FORMING APPARATUS AND A CONTROL METHOD THEREOF

(75) Inventor: Gyeong-hun Jo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 631 days.

(21) Appl. No.: 12/391,494

(22) Filed: Feb. 24, 2009

(65) Prior Publication Data

US 2010/0003038 A1 Jan. 7, 2010

(30) Foreign Application Priority Data

Jul. 7, 2008 (KR) ..... 2008-65689

(51) Int. Cl.
*G03G 15/00* (2006.01)

(52) U.S. Cl. ..... 399/82; 399/81

(58) Field of Classification Search ..... 399/38, 399/45, 75, 81, 82, 85–87, 391, 393; 358/1.12, 358/1.14, 1.15
See application file for complete search history.

(56) References Cited

U.S. PATENT DOCUMENTS 7,474,424 B2 * 1/2009 Hokiyama ..... 358/1.15
7,831,193 B2 * 11/2010 Minakuchi ..... 399/391

* cited by examiner

*Primary Examiner* — Hoan Tran
(74) *Attorney, Agent, or Firm* — Staas & Halsey LLP

(57) ABSTRACT

A print method of an image forming apparatus that loads at least one sheet of print media in a print media feeding tray, the method including: setting a print-all-paper mode to perform a print operation on the print media loaded in the print media feeding tray without selecting a number of sheets of print media; and performing a print operation on the loaded print media according to the set print-all-paper mode.

25 Claims, 5 Drawing Sheets

IMAGE FORMING APPARATUS AND A CONTROL METHOD THEREOF

CROSS-REFERENCE TO RELATED APPLICATION

This application claims the benefit of Korean Application No. 2008-65689, filed Jul. 7, 2008 in the Korean Intellectual Property Office, the disclosure of which is incorporated herein by reference.

BACKGROUND OF THE INVENTION

1. Field of the Invention

Aspects of the present invention relate to an image forming apparatus, a host apparatus, and a print method thereof, and more particularly, to an image forming apparatus that performs a print operation on a plurality of sheets of print media, a host apparatus, and a print method thereof.

2. Description of the Related Art

An image forming apparatus forms a print image on a print medium (such as paper, a transparency, film, etc.). The image forming apparatus may be a printer, a photocopier, a facsimile, a multi function device, etc. To print or copy a plurality of sheets of print media from an image forming apparatus, an application (such as a printer driver of a host apparatus) or an operation of selecting the number of sheets of print media supported by the image forming apparatus is used.

Typically, however, a low-end image forming apparatus only provides an input button to perform minimal operations (such as "power on," "start print," "cancel," "copy," "copy 2 sheets of paper," etc.) and a light emitting diode (LED) displaying a current status and error messages, without a user interface to select a number of sheets of print media.

Accordingly, to copy several sheets of paper from the low-end image forming apparatus, a user should select the number of sheets of print media through a host apparatus, press a copy button as many times as the number of sheets of print media to print or constantly press a copy-2-sheets of print media button, which causes inconvenience to a user. Meanwhile, the image forming apparatus performs a print operation until the number of sheets of printed print media reaches the selected number of sheets of print media if receiving a command of printing or copying data having a plurality of pages.

Here, if print media that is loaded in a tray is not sufficient to complete the print operation with respect to the selected number of sheets of print media, the image forming apparatus displays an error message corresponding to the insufficient print media to a user. If a user supplies print media, the image forming apparatus performs the print operation until the number of sheets of printed print media is the same as the selected number of sheets of print media.

Then, even if a user does not want to print any more, the print operation continues unless the print operation is cancelled through the image forming apparatus or the host apparatus. As a result, in some cases a user may be misled to believe that the print operation is completed and may not cancel a print operation even though the print operation is suspended because of insufficient print media. Thus, if a user loads print media in the tray to perform another print operation, the image forming apparatus resumes the previous print operation causing a waste of print media. Also, a user may be inconvenienced as the user should first cancel the previous print operation before loading sheets of print media.

SUMMARY OF THE INVENTION

Aspects of the present invention provide an image forming apparatus that easily prints several sheets of print media without selecting the number of sheets of print media by providing a user interface in an image forming apparatus or a host apparatus to set a print-all-paper mode, a host apparatus and a print method thereof. Also, aspects of the present invention provide an image forming apparatus that skips a complicated process, such as a print cancellation, and prevents unnecessary waste of print media by ending a print operation automatically without a user's cancellation when print media loaded in a tray runs out, a host apparatus and a print method thereof.

According to an aspect of the present invention, there is provided a print method of an image forming apparatus that loads at least one sheet of print media in a print media feeding tray, the method including: setting a print mode to perform a print operation on the print media loaded in the print media feeding tray without selecting a number of sheets of print media; and performing a print operation on the loaded print media according to the set print mode.

The performing of the print operation may include determining if the paper feeding tray runs out of the print media.

The performing of the print operation may include ending the print operation if the print media feeding tray runs out of the print media.

The method may further include asking whether to end the print operation if the print media feeding tray runs out of the print media.

The method may further include displaying whether to end the print operation if the print media feeding tray runs out of the print media.

The setting of the print mode may include selecting the print media feeding tray from among a plurality of print media feeding trays.

The setting of the print mode may include receiving a user's input through a displayable user interface.

The setting of the print mode may include setting the print mode by the image forming apparatus performing the print operation or a host apparatus connected the image forming apparatus.

The method may further include displaying a setting state of the print mode.

The performing of the print operation may include suspending the print operation or ending the print operation according to the print mode.

The performing of the print operation may include changing a number of sheets of print media loaded in the print media feeding tray during the print operation.

According to another aspect of the present invention, there is provided an image forming apparatus that loads at least one sheet of print media in a print media feeding tray, the image forming apparatus including: an image forming unit to perform a print operation based on print data; a user interface to set a print mode to perform the print operation on the at least one sheet of print media loaded in the print media feeding tray without selecting a number of sheets of print media; and a controller to control the image forming unit to perform the print operation on the loaded print media according to the set print mode.

The image forming apparatus may further include a sensing unit to sense the remaining print media in the print media feeding tray.

The controller may control the image forming unit to end the print operation if the print media feeding tray runs out of the print media.

The image forming apparatus may further include a display unit to display a setting state of the print mode.

The controller may control the display unit to ask whether to end the print operation if the print media feeding tray runs out of the print media.

The display unit may display whether to end the print operation if the print media feeding tray runs out of the print media.

The print media feeding tray may be selected from a plurality of print media feeding trays, through the user interface.

The user interface may include a graphic user interface (GUI) to receive an input of the setting of the print mode.

The controller may control the image forming unit to suspend the print operation or to end the print operation according to a user selection.

The controller may control the image forming unit to perform a print operation until a changed number of sheets of print media runs out if the number of sheets of print media loaded in the print media feeding tray is changed during the print operation.

According to yet another aspect of the present invention, there is provided a host apparatus connected to an image forming apparatus, the host apparatus including: a user interface to set a print mode determining remaining print media in a print media feeding tray and ending a print operation if the print media feeding tray runs out of the print media; a communication unit connected to the image forming apparatus; and a controller to control the communication unit to transmit print data.

According to still another aspect of the present invention, there is provided an image forming system that ends a print operation without error, the system including: a host apparatus to generate and to transmit print data; and an image forming apparatus to receive the print data, and to perform the print operation according to the received print data, wherein the print operation ends without error in response to a print media feeding tray of the image forming apparatus running of out print media.

According to another aspect of the present invention, there is provided a print method of an image forming apparatus having at least one sheet of print media in a print media feeding tray, the method including: performing a print operation on the at least one sheet of print media; and ending the print operation without error in response to the print media feeding tray running out of the print media.

According to another aspect of the present invention, there is provided an image forming apparatus having at least one sheet of print media in a print media feeding tray thereof, the image forming apparatus including: an image forming unit to perform a print operation based on print data; and a controller to control the image forming unit to perform the print operation on the at least one sheet of print media and to control the image forming unit to end the print operation without error in response to the print media feeding tray running out of the print media.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
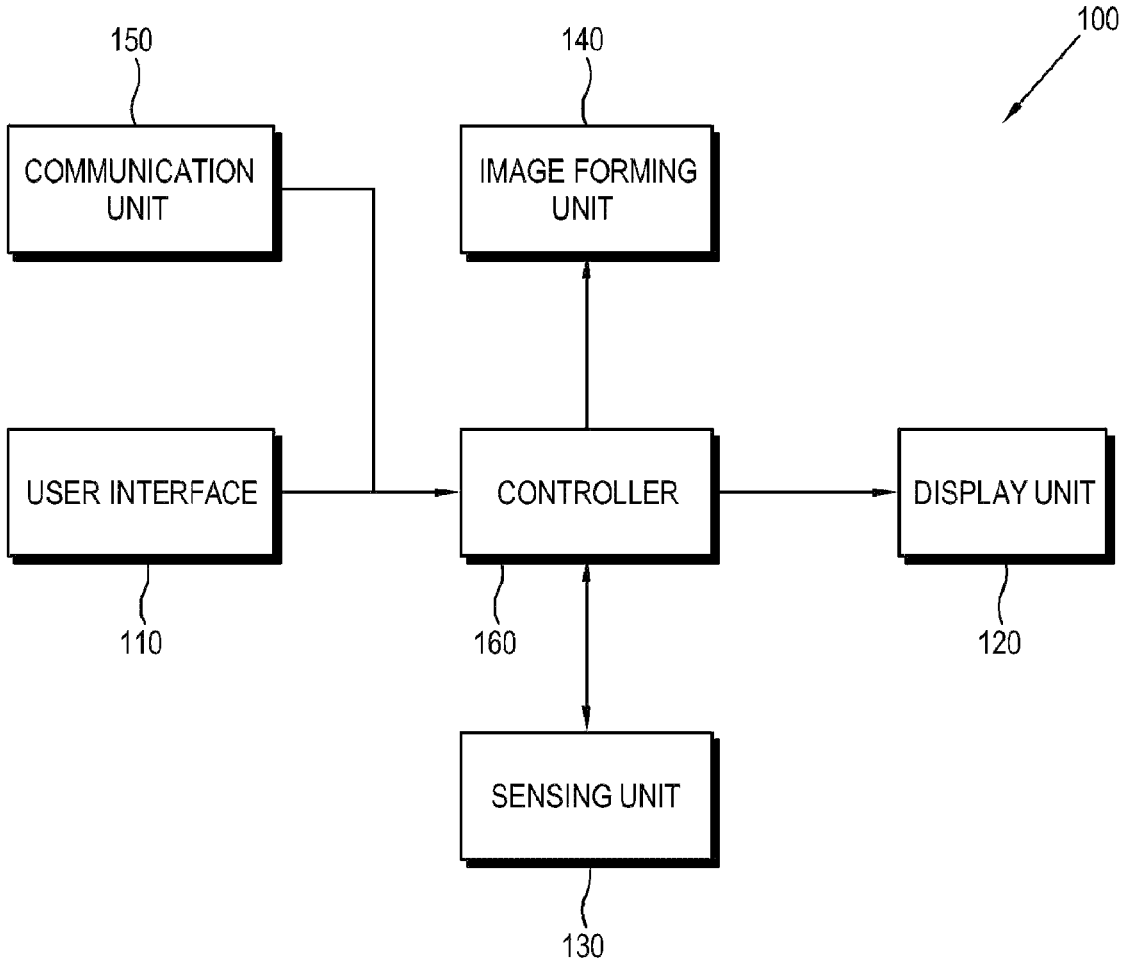
FIG. 1 is a block diagram of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a block diagram of an image forming apparatus 100 according to an embodiment of the present invention. The image forming apparatus 100 may be a printer, a photocopier, a facsimile, a multi-function device providing at least two functions, etc. According to aspects of the present invention the image forming apparatus 100 performs a print operation on at least one sheet of print medium with respect to print data. Here, the print operation may be a print operation to copy a print medium after a document scanning, a print operation of received fax data, a print operation of print data received from an outside through a host apparatus having a server or print data stored inside of the image forming apparatus 100 (for example, in a hard disk drive) or outside of the image forming apparatus (for example, in a USB memory device).

Referring to FIG. 1, the image forming apparatus 100 includes a user interface 110, a display unit 120, a sensing unit 130, an image forming unit 140, a communication unit 150, and a controller 160. The user interface 110 receives a user's selection to set a mode to print all print media loaded in a print media feeding tray until a print operation is completed (hereinafter, referred to as "print-all-paper mode" as a non-limiting example). Under the print-all-paper mode, the image forming apparatus 100 determines if print media for a print command remains in a print media feeding tray, and ends the print operation without errors if all of the loaded print media runs out.

Here, a user may select at least one print media feeding tray applied with the print-all-paper mode, among a plurality of print media feeding trays, through the user interface 110. Specifically, if the image forming apparatus 100 includes a plurality of print media feeding trays, a user may set the print-all-paper mode for one of the plurality of print media feeding trays, some of the print media feeding trays, or all of the print media feeding trays. For example, if the image forming apparatus 100 includes tray 1 and tray 2 and a user sets the print-all-paper mode for all of the print media feeding trays, the image forming apparatus 100 ends a print operation after printing on all of the print media loaded in the trays 1 and 2. Here, the print media feeding trays may include a print media feeding cassette and/or a manual print media feeding tray.

The user interface 110 may include a panel (key button) to display operations of the image forming apparatus 100 or a graphic user interface (GUI) generated by an execution of a printer driver or an additional application and displayed on the display unit 120 to be selected by a user. If the user interface 110 includes a GUI, the image forming apparatus 100 displays the GUI to set the print-all-paper mode, and receives a user's input through the displayed GUI.

Figure 2:
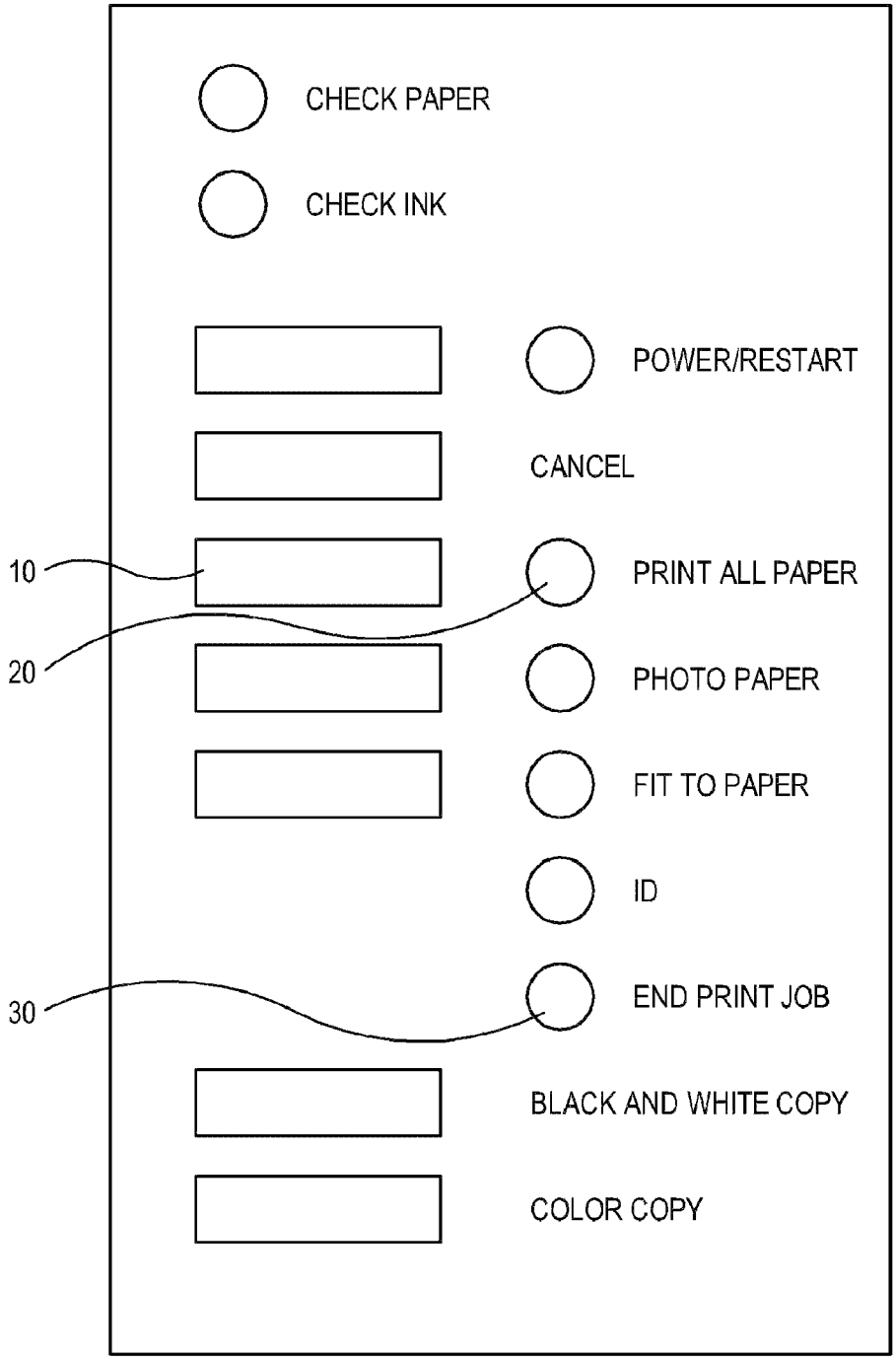
FIG. 2 illustrates an example of a user interface and a display unit according to an embodiment of the present invention.

FIG. 2 illustrates an example of the user interface 110 and the display unit 120 according to an embodiment of the present invention. Referring to FIG. 2, the user interface 110 includes a mode button 10 corresponding to the print-all-paper mode. If a user presses the mode button 10 corresponding to the print-all-paper mode, the controller 160 determines that the print-all-paper mode is set.

The display unit 120 displays setting and operation states of the image forming apparatus 100. Specifically, the controller 160 displays the setting state of the print-all-paper mode through the display unit 120 if a user sets the print-all-paper mode through the user interface 110. The display unit 120 may include a light emitting diode (LED), a thin film transistor-liquid crystal display (TFT-LCD) or a driver (not shown) to drive the TFT-LCD. As illustrated in FIG. 2, the controller 160 displays the set print-all-paper mode through an LED 20 corresponding to the print-all-paper mode for a user. If a print operation according to the print-all-paper mode is completed and the print media feeding tray runs out of the loaded print media, the controller 160 may end the print operation normally and display, through another LED 30, an indication that the print operation is ended normally. Furthermore, the controller may ask a user whether to end the print operation, instead of displaying an error message such as insufficient print media.

The user interface 110 and the display unit 120 in FIG. 2 may be employed in a low-end image forming apparatus that does not support an operation of setting a number of sheets of print media, though it is understood that aspects of the present invention are not limited thereto. Moreover, the display unit 120 may implement a touch screen to receive user inputs directly. Additionally or alternatively, the image forming apparatus 100 may include other devices, buttons, etc., from which to receive user inputs.

Referring back to FIG. 1, the sensing unit 130 senses whether print media remains in at least one print media feeding tray and transmits the sensing result to the controller 160. The sensing unit 130 may include a sensor that is provided in the print media feeding tray and senses whether print media remains in the concerned print media feeding tray.

The image forming unit 140 forms a print image on print media based on print data according to a received print command. Specifically, under the set print-all-paper mode, the image forming unit 140 prints the print data if print media remains in the print media feeding tray, and ends the print operation if the print media runs out, according to the sensing result of the sensing unit 130 with respect to print media remaining in at least one print media feeding tray.

The communication unit 150 receives print data from an outside source. The communication unit 150 may include a USB port to be connected to an external device (such as a host apparatus) locally or through a network, and/or a wired/wireless communication module. The received print data is converted into an image and printed by the image forming unit 140. It is understood that aspects of the present invention are not limited to the print data being received from an outside source. For example, according to other aspects, the print data is generated in the image forming apparatus 100 (for example, by a scanning unit).

The controller 160 controls the image forming apparatus 100 as a whole. Specifically, the controller 160 controls the sensing unit 130 to sense the remaining print media in at least one print media feeding tray according to a print command if the print-all-paper mode is set by the user interface 110, and controls the image forming unit 140 to print the print data based on the sensing result if print media still remains in the print media feeding tray. If the print media does not remain in the print media feeding tray, the controller 160 controls the image forming unit 140 to end the print operation.

Furthermore, if the print media feeding tray runs out of the print media, the controller 160 may control the display unit 120 to display a question (or any other message) to provide a user with a choice to end the print operation. Accordingly, a user may select to end or to continue the print operation in response to the question displayed through the user interface 110. The controller 160 controls the image forming unit 140 to end or to continue the print operation based on the selection result.

If one or some of a plurality of print media feeding trays is set in the print-all-paper mode, the controller 160 controls only the respective sensing unit 130 to sense the remaining print media of the corresponding print media feeding tray, and controls the image forming unit 140 to end the print operation if the print media feeding tray set in the print-all-paper mode does not have print media therein.

The controller 160 may control the display unit 120 to display the print-all-paper mode for a user if the print-all-paper mode is set, and may control the display unit 120 to display a question (or other message) to ask whether to end the print operation if no print media loaded in the corresponding print media feeding tray remains.

The image forming apparatus 100 may either suspend or end the print operation (for example, according to a user input through the user interface 100) while the print operation is performed according to the set print-all-paper mode. Specifically, the image forming apparatus 100 may include a button corresponding to the suspension of the print operation and a button corresponding to an ending of the print operation to suspend the print operation temporarily or end the ongoing print operation, respectively. According to other aspects, the image forming apparatus 100 may include a single button to select between both operations.

A number of sheets of print media loaded in the print media feeding tray may be changed when the ongoing print operation is suspended or ended. If the number of sheets of print media loaded in the print media feeding tray is changed, the image forming apparatus 100 performs a print operation with respect to the changed number of sheets of print media in the print-all-paper mode. Furthermore, while the print operation is ongoing according to the print-all-paper mode, the number of sheets of print media loaded in the print media feeding tray may be changed without additional suspension or end of the print operation. For example, while the image forming apparatus 100 has printed 50 sheets of print media in the print-all-paper mode among 100 sheets of print media loaded in the print media feeding tray, the image forming apparatus 100 ends the print operation after printing another 30 sheets of print media if the 50 sheets of print media remaining in the print media feeding tray is changed to 30 sheets of print media. Accordingly, a total of printed sheets of print media is 80.

Figure 3:
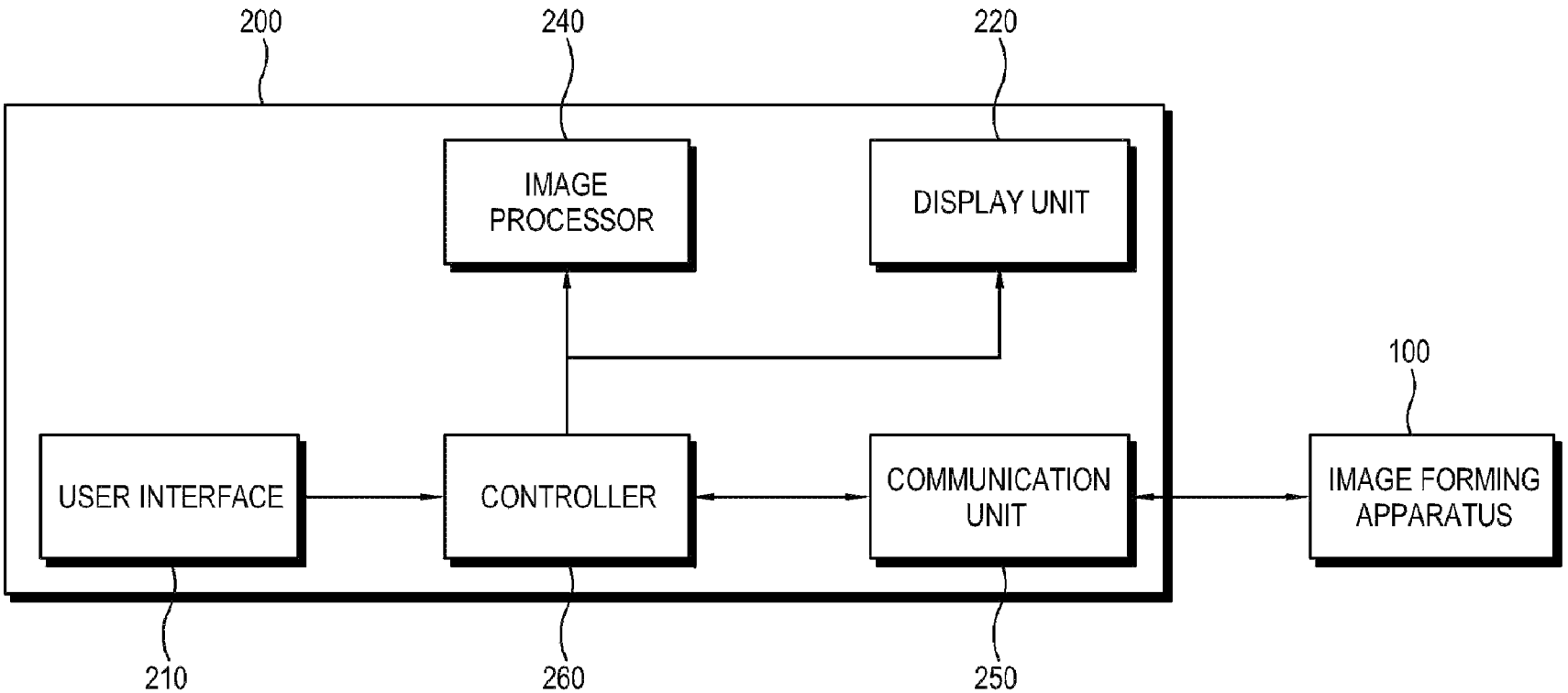
FIG. 3 is a block diagram of a host apparatus that is connected to an image forming apparatus according to another embodiment of the present invention.

According to another embodiment of the present invention, a user may set the print-all-paper mode through a host apparatus, and the image forming apparatus 100 may receive information about the set print-all-paper mode from the host apparatus 200 to perform a print operation. The host apparatus may be a personal computer (PC), a laptop computer, a mobile phone, a personal digital assistant, etc. that transmits print data to the image forming apparatus 100 or performs operations according to a print mode by an execution of a printer driver and/or an additional application. FIG. 3 is a block diagram of a host apparatus 200 that is connected to the image forming apparatus 100 according to another embodiment of the present invention. Referring to FIG. 3, the host apparatus 200 includes a user interface 210, a display unit 220, an image processor 240, a communication unit 250, and a controller 260.

The user interface 210 receives a user's selection to set a print-all-paper mode. The print-all-paper mode is used to perform a print operation until all of the print media loaded in a print media feeding tray is printed without selecting a number of sheets of print media. Thus, the image forming apparatus 100 determines the remaining print media in the print media feeding tray according to a print command and ends the print operation without errors if the print media feeding tray runs out of print media. Here, a user may select through the user interface 210 at least one print media feeding tray that is applied with the print-all-paper mode among a plurality of print media feeding trays. Specifically, the host apparatus 200 receives information about the print media feeding trays of the image forming apparatus 100, and may set the print-all-paper mode for one, some, or all of the plurality of print media feeding trays if the image forming apparatus 100 includes the print media of paper feeding trays. The user interface 210 may include a mouse, a keyboard, a touch screen, etc. to receive a user's selection from the host apparatus 200. The user interface 210 may also include a graphic user interface (GUI) that is generated by an execution of a printer driver and/or an additional application and displayed on the display unit 220 to receive a user's input. It is understood that according to other aspects, the print-all-paper mode is not set by a user, but is a default mode.

Figure 4:
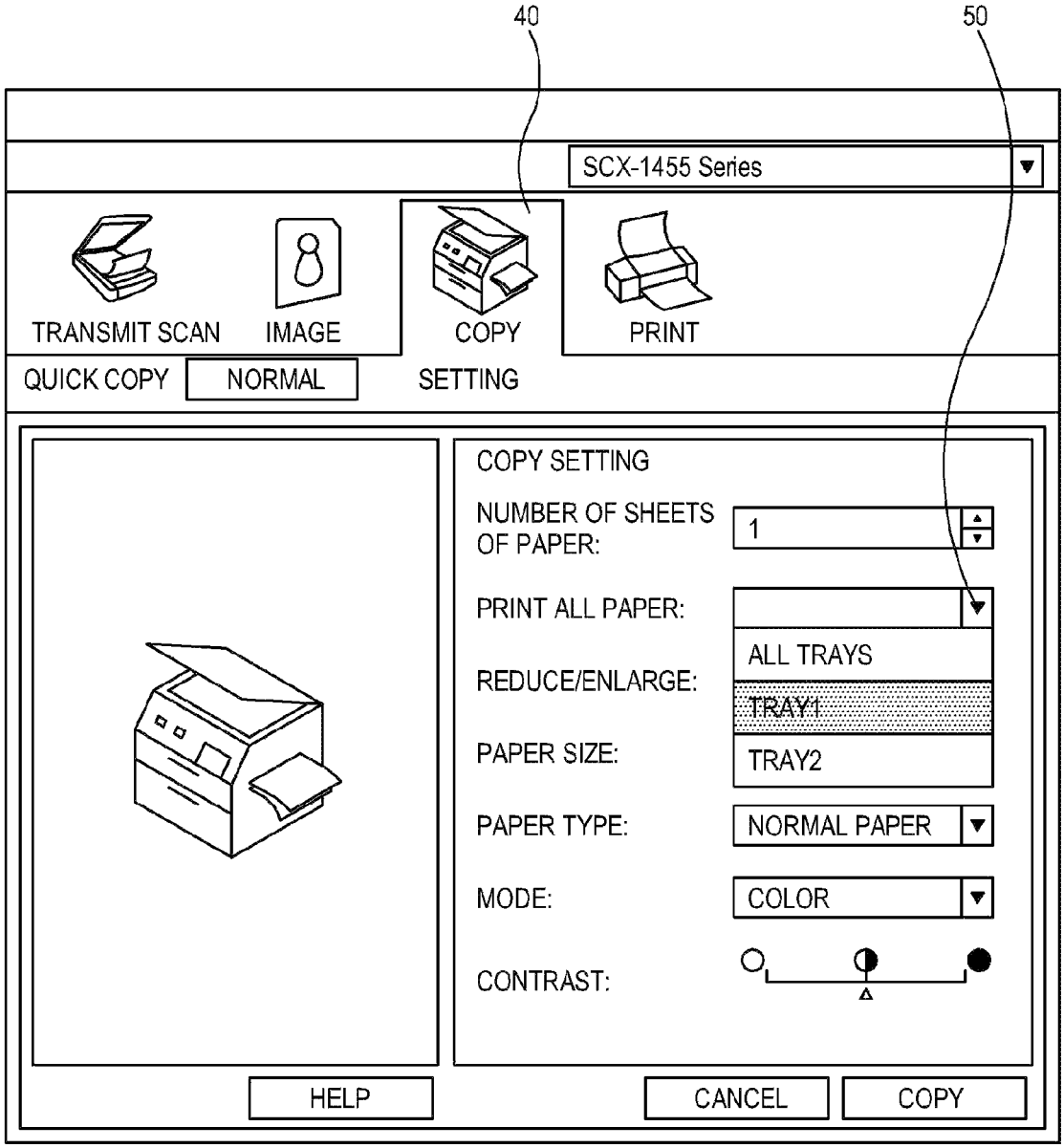
FIG. 4 illustrates an example of a user interface and a display unit according to another embodiment of the present invention.

FIG. 4 illustrates an example of a user interface and a display unit according to another embodiment of the present invention. Referring to FIG. 4, a host apparatus 200 may execute a printer driver or a specific application setting an image forming apparatus 100 to receive various inputs about a print or copy operation. Specifically, if a user selects a tab through a user interface 210, the image forming apparatus 100 performs an operation according to the set tab. For example, referring to FIG. 4, if a user desires to perform a copy operation in the print-all-paper mode of the image forming apparatus 100 having print media feeding trays 1 and 2 (i.e., two print media feeding trays), the user may select a copy tab 40 of the host apparatus 200 and a box 50 corresponding to the print-all-paper mode to set a print media feeding tray to be applied with the print-all-paper mode. If one, some, or all of the print media feeding trays is selected, the controller 160 determines that the print-all-paper mode is set, and determines whether print media remains in the corresponding print media feeding tray to perform a print operation until the print media runs out.

The display unit 120 and/or 220 displays setting and operation states of the image forming apparatus 100. Specifically, if a user sets the print-all-paper mode through the user interface 110, the controller 160 and/or 260 displays the setting state of the print-all-paper mode through the display unit 120 and/or 220 for a user. The display unit 120 and/or 220 may include a thin film transistor-liquid crystal display (TFT-LCD) and a driver (not shown) to drive the TFT-LCD.

The image processor 240 generates print data having a predetermined print language by using original print data. The generated print data is transmitted to the image forming apparatus 100 through the communication unit 250. The communication unit 250 may transmit setting information about the print-all-paper mode to the image forming apparatus 100. The communication unit 250 may include a USB port and/or a wired/wireless communication module to be connected locally or by a network to the image forming apparatus 100.

The controller 260 controls the host apparatus 200 as a whole. Specifically, if the print-all-paper mode is set by the user interface 210, the controller 260 controls the communication unit 250 to transmit print data and the setting information about the print-all-paper mode to the image forming apparatus 100.

If the setting information about the print-all-paper mode is received and the print operation is completed with respect to the print media loaded in the corresponding print media feeding tray, the image forming apparatus 100 ends the print operation. However, it is understood that aspects of the present invention are not limited thereto. According to other aspects, the host apparatus 200 ends the print operation. Specifically, the host apparatus 200 receives information from the image forming apparatus 100 indicating that the corresponding print media feeding tray has run out of print media, and the host apparatus 200 then sends a request or command to the image forming apparatus 200 to end or to suspend the print operation.

Figure 5:
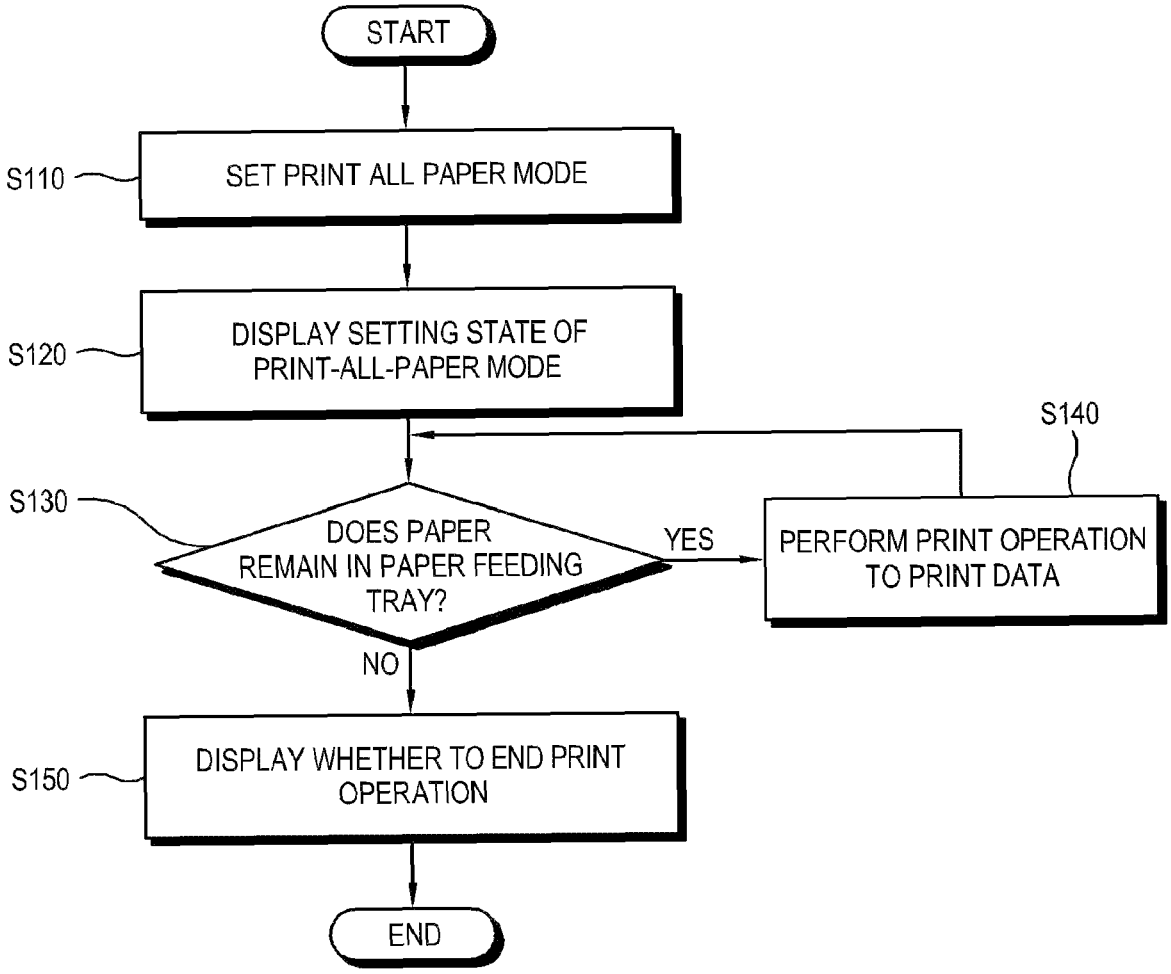
FIG. 5 is a flowchart describing a print method of an image forming apparatus according to an embodiment of the present invention.

Hereinafter, a print process of the image forming apparatus 100 or the host apparatus 200 having the foregoing configuration will be described with reference to FIG. 5. Referring to FIG. 5, a user sets the print-all-paper mode while inputting a print command through the user interface 110 provided in the image forming apparatus 100 and/or the host apparatus 200 in operation S110. A user may select at least one print media feeding tray to be applied with the print-all-paper mode among a plurality of print media feeding trays. However, it is understood that according to other aspects, the print-all-paper mode is set as a default, and not according to a user input.

The image forming apparatus 100 or the host apparatus 200 displays the set print-all-paper mode for a user in operation S120, though it is understood that all aspects of the present are not limited thereto (i.e., a setting of the print-all-paper mode may not be displayed). If the print-all-paper mode is set in the host apparatus 200, the host apparatus 200 may transmit the setting information to the image forming apparatus 100.

According to the set print-all-paper mode (operation S110), the image forming apparatus 100 determines if print media remains in the print media feeding tray set in the print-all-paper mode through the sensing unit 130 in operation S130. If print media remains in the print media feeding tray (operation S130), the image forming apparatus 100 prints the print data in operation S140. Operations 130 and 140 are repeated a print operation is completed or until no print media loaded in the print media feeding tray set in the print-all-paper mode remains, as determined in operation 130. If print media does not remain in the print media feeding tray (operation S130), the image forming apparatus 100 displays an indication of a completion of the print operation for a user in operation S150, and ends the print operation.

If print media does not remain in the print media feeding tray, the image forming apparatus 100 and/or the host apparatus 200 may ask a user whether to end the print operation, and then end the print operation depending on the result. If the number of sheets of print media loaded in the print media feeding tray is changed during the print operation (operation S140), the image forming apparatus 100 and/or the host apparatus 200 may continue to perform the print operation until the changed number of sheets of print media runs out.

The image forming apparatus 100 and/or the host apparatus 200 according to aspects of the present invention may easily print several sheets of print media in a print-all-paper mode without selecting the number of sheets of print media.

For example, a user may control a number of copies of a document to be printed based on a number of sheets of print media in a print media feeding tray, as opposed to inputting a number of copies. Furthermore, the image forming apparatus 100 and/or the host apparatus 200 according to aspects of the present invention may normally end the print operation without an additional cancellation if all of the print media loaded in the print media feeding tray is printed.

As described above, an image forming apparatus, a host apparatus, and a print method thereof according to aspects of the present invention includes a user interface to set a print-all-paper mode, and easily prints several sheets of print media without selecting the number of sheets of print media.

Aspects of the present invention can also be embodied as computer-readable codes on a computer-readable recording medium. Also, codes and code segments to accomplish the present invention can be easily construed by programmers skilled in the art to which the present invention pertains. The computer-readable recording medium is any data storage device that can store data which can be thereafter read by a computer system or computer code processing apparatus. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Aspects of the present invention may also be realized as a data signal embodied in a carrier wave and comprising a program readable by a computer and transmittable over the Internet.

Although a few embodiments of the present invention have been shown and described, it would be appreciated by those skilled in the art that changes may be made in this embodiments without departing from the principles and spirit of the invention, the scope of which is defined in the appended claims and their equivalents.

What is claimed is:

1. A print method of an image forming apparatus having at least one sheet of print media in a print media feeding tray, the method comprising:

setting a print mode to perform a print operation on the at least one sheet of print media loaded in the print media feeding tray;

determining if the print mode is a print-all-paper print operation;

performing the print operation on the at least one sheet of print media according to the set print mode; and ending the print operation without error in response to the print media feeding tray running out of the print media, according to the set print mode.

2. The method as claimed in claim 1, wherein:

the setting of the print mode comprises setting the print mode without selecting a number of sheets of print media to be printed; and the performing of the print operation comprises performing the print operation on all of the sheets of print media loaded in the print media feeding tray.

3. The method as claimed in claim 1, wherein the performing of the print operation comprises determining if the print media feeding tray runs out of the print media.

4. The method as claimed in claim 3, wherein the ending of the print operation comprises ending the print operation without error if the print media feeding tray is determined to have run out of the print media.

5. The method as claimed in claim 4, wherein the ending of the print operation without error if the at least one sheet of print media is determined to not remain comprises asking whether to end the print operation if the print media feeding tray is determined to have run out of the print media.

6. The method as claimed in claim 4, further comprising displaying an indication that the print operation ends in response to the print media feeding tray running out of the print media.

7. The method as claimed in claim 1, wherein the setting of the print mode comprises setting the print mode for the print media feeding tray from among a plurality of print media feeding trays of the image forming apparatus.

8. The method as claimed in claim 1, wherein the setting of the print mode comprises receiving a user's input to set the print mode through a displayable user interface.

9. The method as claimed in claim 1, wherein the setting of the print mode comprises setting the print mode by the image forming apparatus performing the print operation or a host apparatus connected to the image forming apparatus.

10. The method as claimed in claim 1, further comprising displaying a setting state of the print mode.

11. The method as claimed in claim 1, wherein the ending of the print operation comprises suspending the print operation without error or ending the print operation without error according to a user selection.

12. The method as claimed in claim 1, wherein:

the performing of the print operation comprises changing a number of sheets of print media loaded in the print media feeding tray during the print operation; and ending the print operation without error in response to the print media feeding tray running out of the changed number of sheet of print media loaded in the print media feeding tray.

13. An image forming apparatus having at least one sheet of print media in a print media feeding tray thereof, the image forming apparatus comprising:

an image forming unit to perform a print operation based on print data;

a user interface to set a print mode to perform the print operation on the at least one sheet of print media loaded in the print media feeding tray;

a controller to control the image forming unit to perform the print operation on the at least one sheet of print media according to the set print mode and to control the image forming unit to end the print operation without error in response to the print media feeding tray running out of the print media, according to the set print mode;

wherein the controller determines if the print mode is a print-all-paper print operation.

14. The image forming apparatus as claimed in claim 13, wherein:

the user interface sets the print mode without selecting a number of sheets of print media to be printed; and the controller controls the image forming unit to perform the print operation on all of the sheets of print media loaded in the print media feeding tray.

15. The image forming apparatus as claimed in claim 13, further comprising a sensing unit to sense if the print media feeding tray runs out of the print media.

16. The image forming apparatus as claimed in claim 15, wherein the controller controls the image forming unit to end the print operation if the sensing unit senses that the print media feeding tray runs out of the print media.

17. The image forming apparatus as claimed in claim 13, further comprising a display unit to display a setting state of the print mode.

18. The image forming apparatus as claimed in claim 17, wherein the controller controls the display unit to ask whether to end the print operation if the print media feeding tray runs out of the print media.

19. The image forming apparatus as claimed in claim 17, wherein the display unit displays an indication that the print operation ends in response to the print media feeding tray running out of the print media.

20. The image forming apparatus as claimed in claim 13, wherein the print media feeding tray is selected, through the user interface, from among a plurality of print media feeding trays.

21. The image forming apparatus as claimed in claim 13, wherein the user interface comprises a graphic user interface (GUI) to receive inputs to set and/or to configure the print mode.

22. The image forming apparatus as claimed in claim 13, wherein the controller controls the image forming unit to suspend the print operation without error or to end the print operation without error according to a user selection through the user interface.

23. The image forming apparatus as claimed in claim 13, wherein if a number of sheets of print media loaded in the print media feeding tray is changed during the print operation, the controller controls the image forming unit to end the print operation without error in response to the print media feeding tray running out of the changed number of sheets of print media loaded in the print media feeding tray.

24. A host apparatus connected to an image forming apparatus, the host apparatus comprising:

a user interface to set a print-all-paper print mode that ends a print operation without error if a print media feeding tray of the image forming apparatus runs out of print media;

a communication unit to connect to the image forming apparatus; and a controller to control the communication unit to transmit print data to the image forming apparatus.

25. A print method of an image forming apparatus having a print media feeding tray to load print media, the method comprising:

performing a print operation on all of the loaded print media in the print media feeding tray without setting a number of sheets of print media to print on; and ending the print operation without error in response to the print media feeding tray running out of the print media.

* * * * *